US007841692B2

(12) United States Patent
Taga

(10) Patent No.: US 7,841,692 B2
(45) Date of Patent: Nov. 30, 2010

(54) HEAD MAINTENANCE METHOD, HEAD MAINTENANCE DEVICE, AND PRINTER

(75) Inventor: Susumu Taga, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 1061 days.

(21) Appl. No.: 11/585,182

(22) Filed: Oct. 24, 2006

(65) Prior Publication Data

US 2007/0091140 A1 Apr. 26, 2007

(30) Foreign Application Priority Data

Oct. 26, 2005 (JP) ..... P2005-311955
Mar. 8, 2006 (JP) ..... P2006-063352

(51) Int. Cl.
*B41J 2/165* (2006.01)

(52) U.S. Cl. ..... 347/30

(58) Field of Classification Search ..... None
See application file for complete search history.

(56) References Cited

U.S. PATENT DOCUMENTS 4,926,196 A * 5/1990 Mizoguchi et al. ..... 347/23
5,724,078 A * 3/1998 Kotaki ..... 347/33
5,784,077 A * 7/1998 Silverbrook ..... 347/2
6,079,808 A * 6/2000 Yamaguchi ..... 347/30
6,082,851 A * 7/2000 Shihoh et al. ..... 347/85
6,338,540 B1 1/2002 Hasegawa et al.
6,398,336 B1 6/2002 Yoda et al.
6,820,956 B2 11/2004 Sakamoto et al.
7,029,090 B2 4/2006 Nishida et al.
2004/0257396 A1 12/2004 Nishida et al.
2005/0007623 A1 1/2005 Sakamoto et al.

FOREIGN PATENT DOCUMENTS

JP 10-315489 12/1998
JP 11-192730 7/1999
JP 11-263024 9/1999
JP 2003-103802 4/2003
JP 2005-7866 1/2005
JP 2005-349841 12/2005

* cited by examiner

*Primary Examiner*—Matthew Luu
*Assistant Examiner*—Alejandro Valencia
(74) *Attorney, Agent, or Firm*—Nixon & Vanderhye P.C.

(57) ABSTRACT

A head maintenance method for a printing head having ink nozzles capable of ejecting an ink liquid, the method includes: performing a cleaning operation by sucking the ink liquid from the ink nozzles; measuring an elapsed time from when the last cleaning operation is performed; and performing the next cleaning operation in response to a cutting operation for automatically cutting a paper which is printed by the printing head during a printing operation, if the elapsed time extends over a predetermined judgment time.

15 Claims, 9 Drawing Sheets

HEAD MAINTENANCE METHOD, HEAD MAINTENANCE DEVICE, AND PRINTER

BACKGROUND

1. Technical Field

The present invention relates to a head maintenance method that performs maintenance of a printing head having ink nozzles capable of ejecting an ink liquid by a cleaning operation, to a head maintenance device, and to a printer.

2. Related Art

As an apparatus including a printing head that has ink nozzles capable of ejecting an ink liquid, there is known an ink jet printer that performs desired printing onto a printing medium by causing the ink liquid to be ejected from the ink nozzles.

In such an ink jet printer, when a state where the ink liquid is not ejected from the ink nozzles, such as a standby state, continues for a predetermined time, water as a solvent of the ink liquid evaporates, viscosity of the ink liquid in the ink nozzles increases, and clogging occurs in the ink nozzles. As a consequence, the ink liquid may not be ejected, or even though the ink liquid is ejected, the ink liquid may not be ejected at an original size or speed, which causes defective printing (hereinafter, referred to as missing dot).

In addition, according to the use states of the printing head, for example, when the printing head repeatedly reciprocates, an ink meniscus in each ink nozzle is destroyed, which causes missing dot.

For this reason, in the ink jet printer, when the printing head is retracted at a standby position, the ink nozzles of the printing head are covered with a cap, such that an increase in viscosity of the ink liquid in the ink nozzles is prevented.

However, when a print processing is not performed for a long time, the increase in viscosity of the ink liquid in the ink nozzles may not be prevented by only covering the printing head with the cap at the time of standby. Further, when the print processing is continuously performed for a long time, the ink meniscus in each ink nozzle is destroyed during printing, which causes missing dot.

Accordingly, the ink jet printer has a cleaning mechanism that forcibly discharges the ink liquid having increased viscosity in the ink nozzles and recovers the ink meniscus.

A cleaning operation that is performed by such a cleaning mechanism includes a flashing operation, which causes the ink liquid to be ejected from the ink nozzles, and a suction and ejection operation where ink having increased viscosity or bubbles in the ink nozzles is discharged to the outside, and new ink liquid is supplied to each of the ink nozzles again by driving an ink suction pump connected to the cap and performing suction of the ink liquid remaining in the printing head for a predetermined time, and the like. In general, the suction and ejection operation requires more time compared with the flashing operation as a slight cleaning operation.

There is known an ink jet printer that, at a timing at which printing starts, that is, at a timing at which image data required for once scanning is stored in a printing buffer, selects a kind of cleaning operation according to the elapsed time from a last cleaning operation and performs cleaning of the printing head by the selected cleaning operation (for example, see JP-A-2003-103802).

However, in the known ink jet printer described in JP-A-2003-103802, the cleaning operation is performed immediately before printing starts, and thus a time at which printing actually starts is delayed by the time required for the cleaning operation. Accordingly, it takes additional time waiting for printing to end. In particular, when the cleaning operation by the suction and ejection operation is performed, it takes a considerably longer time waiting for printing to start.

For example, in a printer that prints a coupon to be issued to a customer at a checkout counter of a supermarket, when the cleaning operation by the suction and ejection operation is performed immediately before printing, it takes a longer time to deliver the coupon to the customer. Accordingly, the customer and waiting customers are kept waiting, and work efficiency at the checkout counter is degraded.

SUMMARY

Accordingly, it is an object of the invention to provide a head maintenance method, a head maintenance device, and a printer, wherein when a cleaning operation is performed on a printing head according to an elapsed time from the last cleaning operation before printing starts, the time waiting for printing to start due to the cleaning operation is markedly reduced, thereby improving throughput.

According to an aspect of the invention, a head maintenance method for a printing head having ink nozzles capable of ejecting an ink liquid, the method includes:

performing a cleaning operation by sucking the ink liquid from the ink nozzles;.

measuring an elapsed time from when the last cleaning operation is performed; and performing the next cleaning operation in response to a cutting operation for automatically cutting a paper which is printed by the printing head during a printing operation, if the elapsed time extends over a predetermined judgment time According to another aspect of the invention, a head maintenance device includes:

a printing head that has ink nozzles capable of ejecting an ink liquid;

a cleaning mechanism that sucks the ink liquid and causes the ink liquid to be ejected from the nozzles of the printing head so as to clean the printing head;

a cleaning driving control circuit that operates the cleaning mechanism to perform a cleaning operation;

a cleaning lapse timer that measures an elapsed time from the last cleaning operation;

a cutting mechanism that cuts a paper automatically after a printing operation by the printing head ends; and a controller that starts the cleaning driving control circuit for the next cleaning operation in response to the cutting operation by the cutting mechanism, if the elapsed time extends over a predetermined judgment time.

According to the head maintenance method and the head maintenance device, when the elapsed time from when the last cleaning operation is performed extends over the judgment time, the next cleaning operation is performed after the printer paper is cut. Therefore, it is possible to avoid the problem inherent in the related art in that a timing at which printing actually starts is delayed due to a cleaning operation to be performed when printing starts, and it is possible to reduce a time waiting for printing to end, thereby improving throughput. In addition, since the cleaning operation is performed whenever the judgment time substantially lapses, the ink nozzles can be kept in a well-maintained state.

In the head maintenance method according to an aspect of the invention and the head maintenance device according to another aspect of the invention, when the elapsed time from when the last cleaning operation ends extends over a predetermined time longer than the judgment time, the next cleaning operation may be performed before the printing operation starts without the cutting operation. In addition, when a predetermined time longer than the judgment time lapses, the next cleaning operation may be performed without the cutting operation.

According to the above-described head maintenance method and head maintenance device, when the predetermined time lapses after the last cleaning operation is performed and before the printing operation is not performed, the next cleaning operation is performed without waiting for a next printing to start. Therefore, the ink nozzles can be constantly kept in a well-maintained state, and degradation in printing quality, such as missing dot, can be prevented.

The head maintenance device according to an aspect of the invention and the head maintenance device according to another aspect of the invention may further include a cleaning accumulation counter that counts the number of accumulation times of the start of the cleaning driving control circuit. When it is judged whether or not the measured time is equal to or more than the judgment time, and the number of accumulation times of the cleaning accumulation counter is a multiple of a predetermined number, the controller may apply, to the cleaning driving control circuit, a setting for a stronger cleaning operation compared with a case where the number of accumulation times is not the multiple of the predetermined number.

According to the above-described head maintenance method and head maintenance device, when an instruction is received in such a manner and the elapsed time is equal to or more than the judgment time, the cleaning operation is performed. Further, when the number of accumulation times becomes a set multiple of the predetermined number, that is, for every predetermined number of times, a stronger cleaning operation compared with other cases is performed. Therefore, normally, the states of the ink nozzles are kept by performing a suitably strong cleaning operation while suppressing ink consumption. Further, the states of the ink nozzles are reset by performing the stronger cleaning operation for every predetermined number of times. As a result, the ink nozzles can be kept in a well-maintained state.

In the head maintenance method according to an aspect of the invention and the head maintenance device according to aspects of the invention, the strength of the cleaning operation may be determined according to a residual quantity of ink to be supplied to the printing head. With this configuration, a suitably strong cleaning operation can be performed such that ink to be supplied to the printing head is not used up.

According to still another aspect of the invention, a printer includes the above-described head maintenance device.

According to the printer having the above-described configuration, in a state where the printer is continuously used, when the judgment time from when the last cleaning operation is performed lapses, the cleaning operation is performed after the printing operation ends and the cutting operation is performed. Accordingly, the cleaning operation can be prevented from being performed before printing starts, and the ink nozzles can be kept in a well-maintained state. Therefore, a high-quality printing state can be kept, and the time waiting for printing to start due to the cleaning operation is reduced, thereby improving throughput.

According to the head maintenance method, the head maintenance device, and the printer described above, when the elapsed time from when the last cleaning operation is performed lapses over the predetermined judgment time, the cleaning operation is performed after the printing operation by the printing head ends, and the cutting operation is automatically performed on the printed paper. For this reason, when the printing operation ends and the paper is cut in a state where the judgment time lapses from when the last cleaning operation ends, the cleaning operation is performed without waiting for the timing at which next printing starts. Before the judgment time lapses from when the cleaning operation is performed, the next cleaning operation is not performed. Therefore, it is possible to avoid the problem inherent in the related art in that the timing at which printing actually starts is delayed due to the cleaning operation to be performed when printing starts, and it is possible to reduce the time waiting for printing to end, thereby improving throughput.

The present disclosure relates to the subject matter contained in Japanese patent application Nos. 2005-311955 (filed on Oct. 26, 2005) and 2006-063352 (filed on Mar. 8, 2006), each of which is expressly incorporated herein by reference in its entirety.

DESCRIPTION OF EXEMPLARY EMBODIMENTS

A head maintenance method, a head maintenance device, and a printer according to an embodiment of the invention will now be described in detail with reference to the accompanying drawings.

Figure 1:
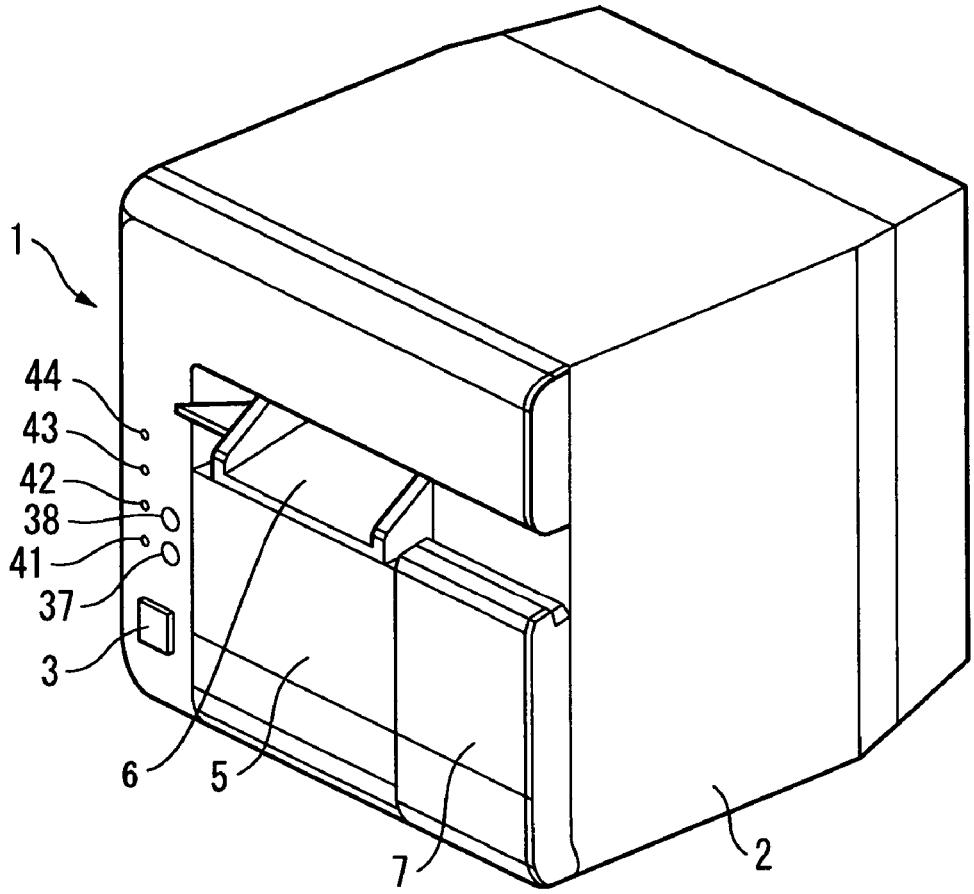
FIG. 1 is an exterior perspective view showing a printer having a head maintenance device that performs a head maintenance method according to an embodiment of the invention.
Figure 2:
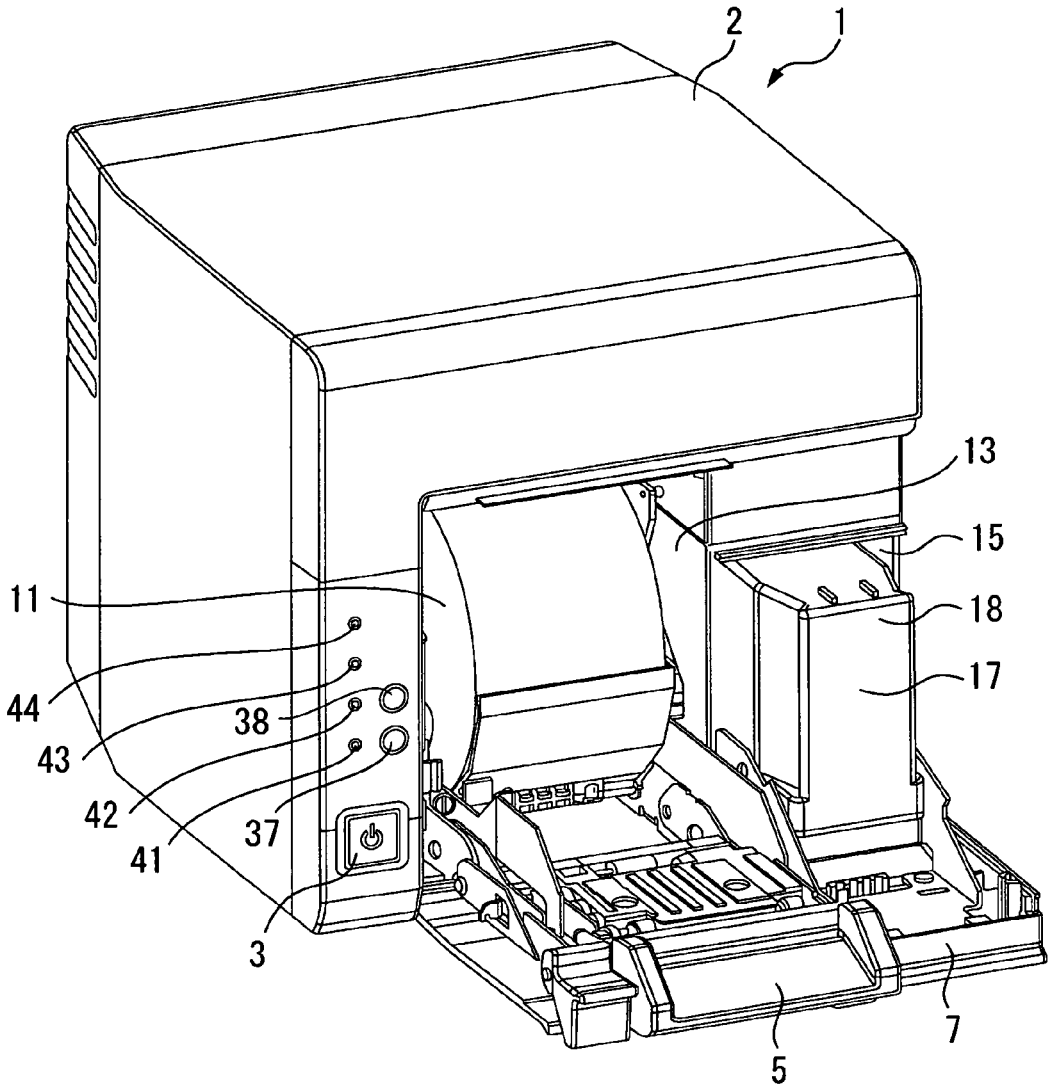
FIG. 2 is a perspective view showing a state where a roll paper cover and a cartridge cover of the printer shown in FIG. 1 are opened.
Figure 3:
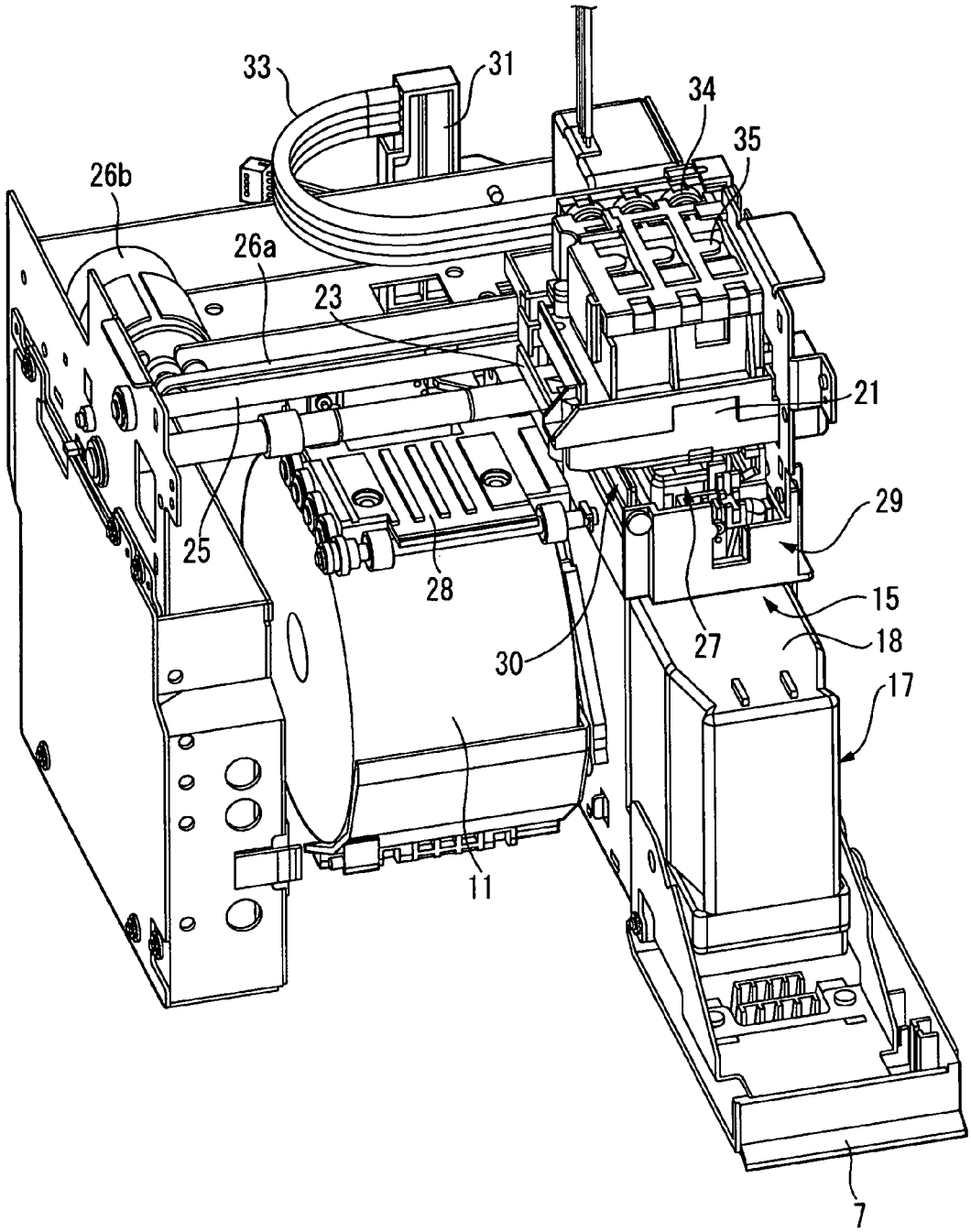
FIG. 3 is a perspective view showing a state where a printer case is removed from the printer shown in FIG. 2.
Figure 4:
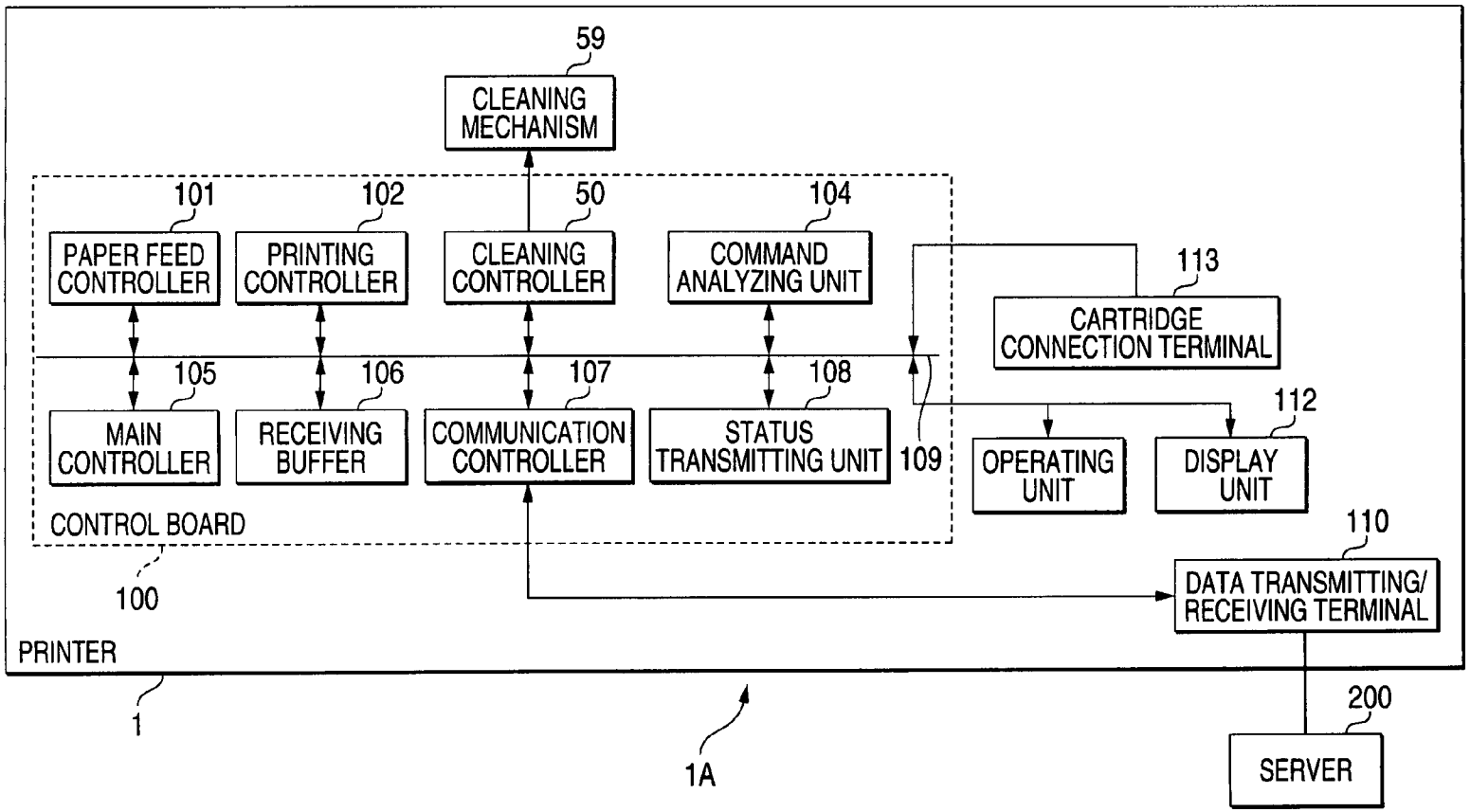
FIG. 4 is a block diagram showing a control system of the printer shown in FIG. 1 and a printer system.
Figure 5:
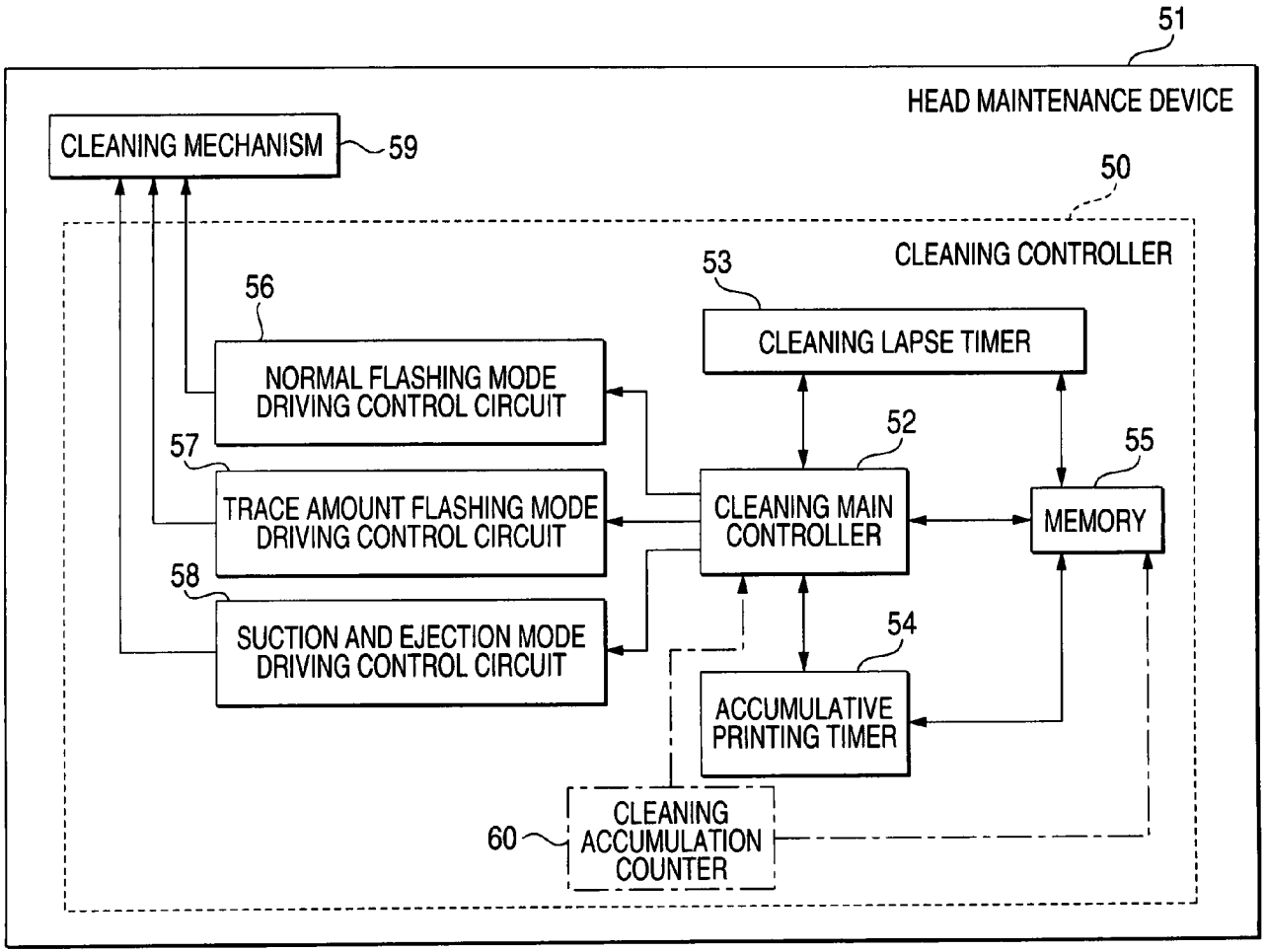
FIG. 5 is a block diagram illustrating a cleaning mechanism in the printer shown in FIG. 1.
Figure 6:
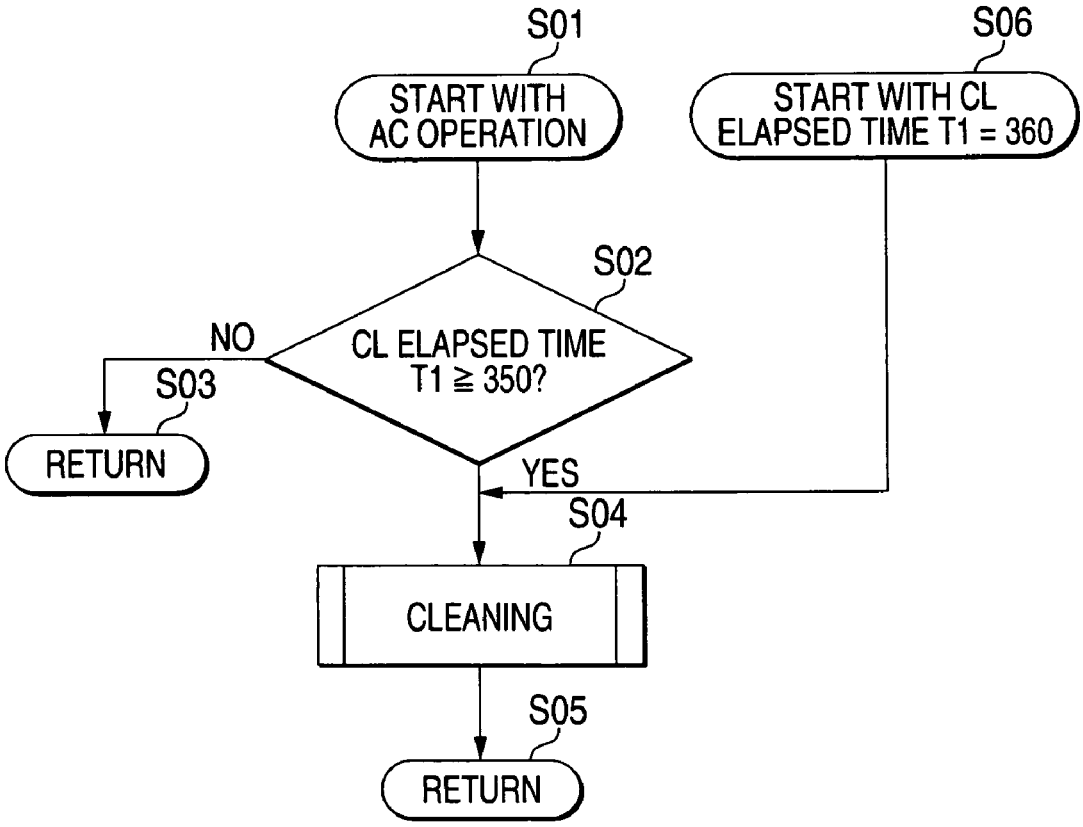
FIG. 6 is a flowchart showing a procedure of a cleaning operation that is performed by a controller mounted on the printer shown in FIG. 5.

FIG. 1 is an exterior perspective view showing a printer having a head maintenance device that performs a head maintenance method according to an embodiment of the invention. FIG. 2 is a perspective view showing a state where a roll paper cover and a cartridge cover of the printer shown in FIG. 1 are opened. FIG. 3 is a perspective view showing a state where a printer case is removed from the printer shown in FIG. 2. FIG. 4 is a block diagram showing a control system of the printer shown in FIG. 1 and a printer system. FIG. 5 is a block diagram illustrating a cleaning mechanism in the printer shown in FIG. 1. FIG. 6 is a flowchart showing cleaning operation procedure that is performed by a controller mounted on the printer shown in FIG. 5.

A printer 1 of this embodiment is an ink jet printer that performs color printing on roll paper using a plurality of color ink liquids. For example, the printer 1 is suitably used to print discount coupons of products in a supermarket. As shown in FIG. 1, a roll paper cover 5 and an ink cartridge cover 7 are openably provided at a front surface of a printer case 2 that covers a printer main body of the printer 1. In addition, a power supply switch 3, a cleaning button 37, a feed switch 38, and four display lamps 41 to 44 are disposed at the front surface of the printer case 2. The cleaning button 37 is an operating member that manually performs a printing head 21 cleaning process in order to solve an inconsistency, such as clogging of the printing head 21.

A paper issuing port 6, from which a printed paper 11*a* is output, is provided at an upper portion of the roller paper cover 5. Further, an automatic cutter 8 is provided on an inner side of the paper issuing port 6 (see FIG. 7). When a portion of the paper 11*a* on which printing is performed is output from the paper issuing port 6, the automatic cutter 8 cuts the paper 11*a* while a portion of the paper 11*a* in a widthwise direction remains in the printer.

Figure 7:
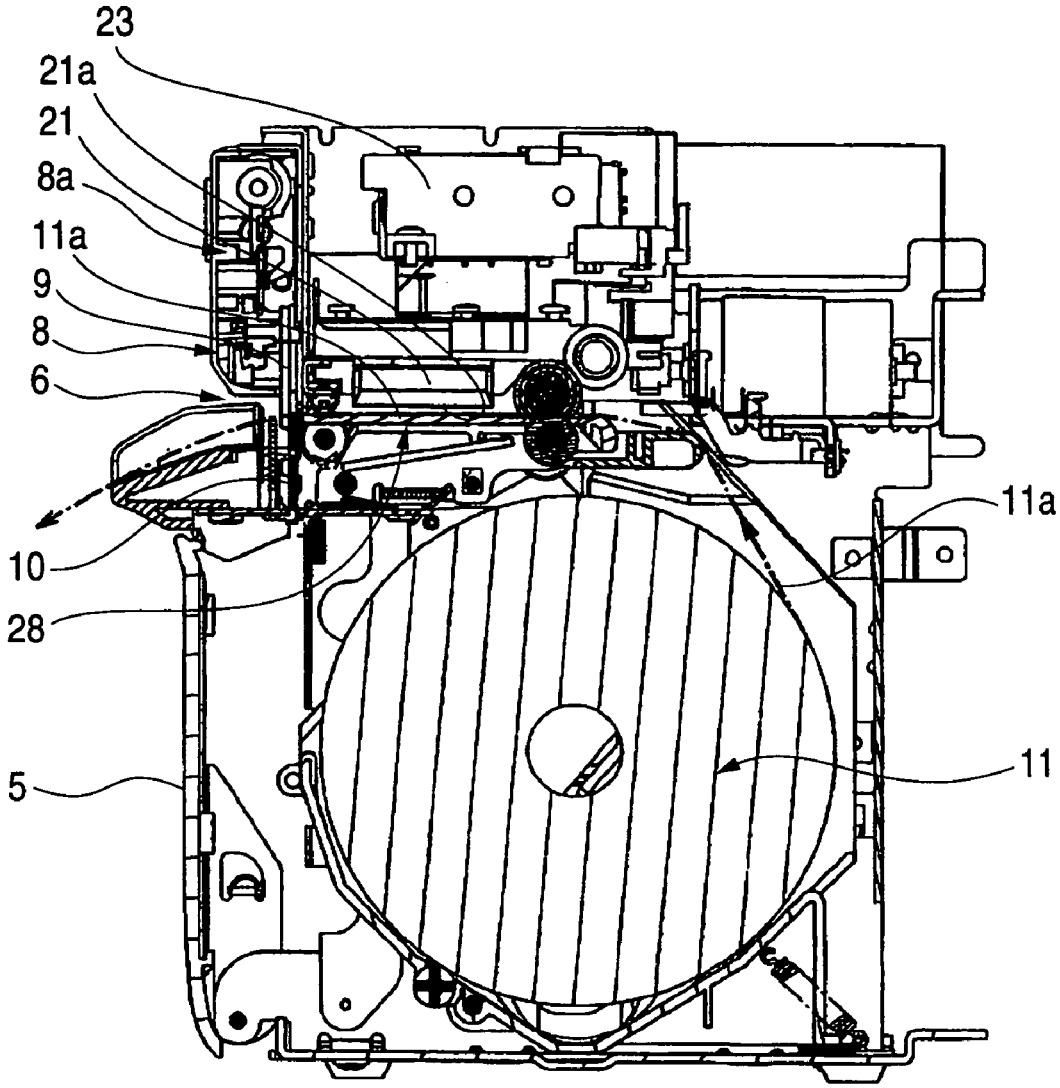
FIG. 7 is a sectional explanatory view of the printer shown in FIG. 1.

The automatic cutter 8 will be described in detail with reference to FIG. 7. A scissor-type automatic cutter 8 is disposed on the inner side of the paper issuing port 6. A fixed blade 10 of the automatic cutter 8 is disposed vertically upward, and a movable blade 9 is disposed vertically downward. The movable blade 9 rotates in an up and down direction by a driving mechanism 8*a* including an exclusive-use motor with one end in a widthwise direction of the printer as a fulcrum. With this arrangement, a contact point of the movable blade 9 with the fixed blade 10 moves in the widthwise direction of the printer, such that the paper 11*a* disposed therebetween can be cut.

When the roll paper cover 5 is opened, as shown in FIG. 2, a paper accommodating portion 13, in which roll paper 11 as printing paper is accommodated, is opened, such that the roll paper 11 can be replaced.

In addition, when the ink cartridge cover 7 is opened, as shown in FIG. 2, a cartridge mounting portion 15 is opened, such that an ink cartridge 17 can be attached to and detached from the cartridge mounting portion 15.

The ink cartridge 17 has a plurality of color ink packs accommodated in a cartridge case 18. In the printer 1 of this embodiment, the ink cartridge 17 is drawn out ahead of the cartridge mounting portion 15 in connection with the open operation of the ink cartridge cover 7.

Above the paper accommodating portion 13 in the printer case 2, as shown in FIG. 3, a carriage 23 on which the printing head 21 is mounted is provided. The carriage 23 is movably supported in the widthwise direction of the paper by a guide member 25 that extends in the widthwise direction of the roll paper 11. The carriage 23 can reciprocate above a platen 28 in the widthwise direction of the roll paper 11 by an endless belt 26*a* extending in the widthwise direction of the roll paper 11. A carriage motor 26*b* drives the endless belt 26*a*.

As shown in the drawings, a position above the cartridge mounting portion 15 becomes a standby position (home position) of the reciprocating carriage 23. Then, below the standby position, a cap 27 covers the ink nozzles as a printing surface 21*a* of the printing head 21 is exposed from a lower surface of the carriage 23, and an ink suction mechanism 29 sucks ink in each of the ink nozzles of the printing head 21 through the cap 27 and discharges ink. Ink that is sucked and discharged by the ink suction mechanism 29 is returned to a waste liquid storage portion in the ink cartridge 17.

As for each of the ink packs in the ink cartridge 17, when the ink cartridge 17 is mounted on the cartridge mounting portion 15, an ink supply needle provided in the cartridge mounting portion 15 is inserted into and connected to an ink supply port of the ink pack. An ink flow passage 31 that is fixed in the printer case 2 is connected to the ink supply needle of the cartridge mounting portion 15. One end of a flexible ink tube 33 is connected to the ink flow passage 31. The other end of the ink tube 33 is connected to each of the ink nozzles of the printing head 21 through a back-pressure adjusting unit 35 that is provided on the printing head 21.

That is, an ink liquid of each of the ink packs in the ink cartridge 17 is supplied from the ink supply needle of the cartridge mounting portion 15 to each of the ink nozzles on the printing head 21 through the ink flow passage 31, the ink tube 33, and the back-pressure adjusting unit 35.

Figure 8:
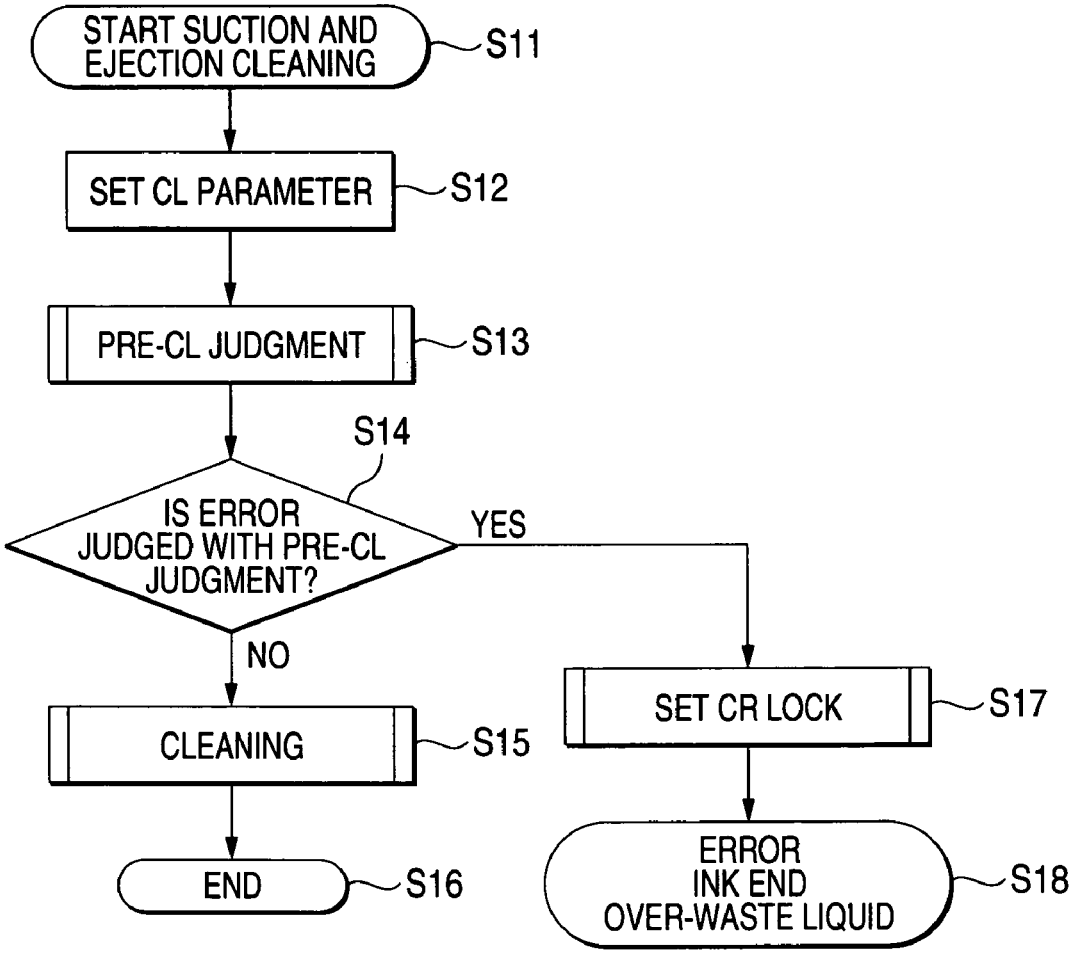
FIG. 8 is a flowchart showing a procedure of a cleaning operation that is performed by a head maintenance device according to a second embodiment of the invention.

FIG. 4 is a block diagram showing a control system of the printer shown in FIG. 1 and a printer system. FIG. 8 is a flowchart showing a procedure of a cleaning operation that is performed by a head maintenance device according to another embodiment of the invention.

An IC chip that stores data, such as an ink residual quantity or a waste liquid quantity of each color, is provided at a side surface of the ink cartridge 17. A cartridge connection terminal 113 (see FIG. 4) provided in the cartridge mounting portion 15 is electrically connected to a connection terminal of the IC chip of the ink cartridge 17, such that data reading and writing from the control system of the printer to the IC chip can be performed.

Next, the control system of the printer 1 will be described.

As shown in FIG. 4, the printer 1 of this embodiment has a cleaning mechanism 59, a data transmitting/receiving terminal 110, an operating unit 111, a display unit 112, and a control board 100 to which the cartridge connection terminal 113 is connected. In a printer system 1A of this embodiment, the printer 1 and a server 200 are connected for communication with each other. A plurality of printers 1 may be provided for one server 200.

The control board 100 is a control device that generally controls individual control mechanisms of the printer 1. In the control board 100, a paper feed controller 101, a printing controller 102, a cleaning controller 50, a command analyzing unit 104, a main controller 105, a receiving buffer 106, a communication controller 107, and a status transmitting unit 108 are connected for communication with one another through a bus 109.

The control board 100 is controlled by starting software read out from a ROM and executes various operations according to various commands from the server 200.

The paper feed controller 101 generates a control signal for driving and controlling a feed mechanism of the roll paper 11 according to various commands transmitted from the server 200. The feed mechanism is driven according to the control signal and feeds the roll paper 11.

The printing controller 102 is a controller that controls printing through the printing head 21. The printing controller 102 controls ink ejection from the ink nozzles of the printing head 21 provided in the carriage 23 and movements of the carriage 23 on the basis of an instruction to print and externally transmitted image data.

The command analyzing unit 104 is an analyzing unit that analyzes the contents of various control commands transmitted from the server 200 that is external to and connected for communication with the printer 1. The analysis results of the command analyzing unit 104 are transmitted to various controllers, such as the paper feed controller 101, the printing controller 102, the cleaning controller 50, and the like, according to the analysis results. Accordingly, the individual controllers perform the controls according to the received control command.

The main controller 105 performs signal delivery among the paper feed controller 101, the printing controller 102, the cleaning controller 50, the command analyzing unit 104, the receiving buffer 106, the communication controller 107, and the status transmitting unit 108 or general control.

The receiving buffer 106 is a data storage area that temporarily stores various commands or image data to be printed that are transmitted from the server 200.

The communication controller 107 is a controller that performs communication with the server 200 through the data transmitting/receiving terminal 110. Various command or data transmitted from the server 200 are temporarily stored in the receiving buffer 106 through the communication controller 107 and then are used by various controllers and the analyzing unit.

The status transmitting unit 108 generates a status signal indicating the state of the printer 1 and transmits the status signal to the server 200 through the communication controller 107 and the data transmitting/receiving terminal 110. The server 200 can grasp the state of the printer 1 by receiving the status signal.

In addition, display may be performed through the display unit 112 or status information may be output to the roll paper 11 on the basis of the status signal generated by the status transmitting unit 108.

The printer 1 of this embodiment includes a head maintenance device 51 shown in FIG. 5.

The head maintenance device 51 performs a cleaning operation on the printing head 21 in order to prevent defective printing, such as missing dot, from occurring due to an increase in viscosity of an ink liquid or destruction of an ink meniscus in each ink nozzle in the printing head 21.

The head maintenance device 51 includes the cleaning mechanism 59 that cleans the printing head 21, a normal flashing mode driving control circuit 56 that operates the cleaning mechanism 59 in a normal flashing mode, a trace amount flashing mode driving control circuit 57 that operates the cleaning mechanism 59 in a trace amount flashing mode, a suction and ejection mode driving control circuit 58 that operates the cleaning mechanism 59 in a suction and ejection mode, a cleaning lapse timer 53 that measures an elapsed time from when a cleaning operation performed by operating the suction and ejection mode driving control circuit 58 ends, an accumulative printing timer 54 that measures an accumulative printing time by the printing head 21, a memory 55 that has an EEPROM or the like, and a cleaning main controller 52 that selectively starts the normal flashing mode driving control circuit 56, the trace amount flashing mode driving control circuit 57, or the suction and ejection mode driving control circuit 58 according to the set condition.

The cleaning mechanism 59 has a wiping mechanism 30 (see FIG. 3) that wipes the ink suction mechanism 29 (see FIG. 3) sucking residual ink in the ink nozzle by an ink suction pump or a front end of the ink nozzle by a wiper blade, or a flashing mechanism (not shown) that causes a small amount of the ink liquid to be ejected from all the ink nozzles.

A cleaning operation in the normal flashing mode by the normal flashing mode driving control circuit 56 does not include a suction and ejection process by the ink suction mechanism 29 but performs a normal flashing operation causing a small amount of the ink liquid to be ejected from all the ink nozzles.

A cleaning operation in the trace amount flashing mode by the trace amount flashing mode driving control circuit 57 does not include the suction and ejection process by the ink suction mechanism 29 but performs a trace amount flashing operation causing a smaller amount of the ink liquid than the normal flashing mode to be ejected from all the ink nozzles.

A cleaning operation in the suction and ejection mode by the suction and ejection mode driving control circuit 58 includes a suction and ejection operation by operating the ink suction pump of the ink suction mechanism 29 and sucking a predetermined amount of the ink liquid from the ink nozzle of the printing head 21, which causes the ink liquid to be ejected from the ink nozzle of the printing head 21 in order to solve an inconsistency, such as clogging of the ink nozzle in the printing head 21. If necessary, after the suction and ejection operation, a regular cleaning process, such as a wiping process of wiping a front end face of the ink nozzle, may be performed. A suction amount of the ink liquid in the suction and ejection operation can be changed according to a degree of clogging of the ink nozzle.

The cleaning lapse timer 53 measures the elapsed time from when a last cleaning operation including the suction and ejection operation by the cleaning mechanism 59 on the printing head 21 ends. The measured time is sequentially stored in the memory 55. Although it is assumed that the printer 1 of this embodiment is used in a state where a power supply is constantly turned on, when the power supply is turned off, the power supply is turned on again, and an actual elapsed time from when the last cleaning operation ended is calculated on the basis of time information transmitted from a host computer and the elapsed time stored in the memory 55.

The accumulative printing timer 54 measures the accumulative printing time by the printing head 21, but actually measures an accumulative time at which the cap 27 does not cover the ink nozzle of the printing head 21. The measured value becomes the accumulative printing time. Further, the time measured by the accumulative printing timer 54 is sequentially stored in the memory 55.

The cleaning main controller 52 selectively starts the normal flashing mode driving control circuit 56, the trace amount flashing mode driving control circuit 57, or the suction and ejection mode driving control circuit 58 according to the set condition. As an example of the operations of the cleaning main controller 52, when printing data for a printing operation is transmitted from the host computer, the cleaning main controller 52 selectively starts the trace amount flashing mode driving control circuit 57, the normal flashing mode driving control circuit 56, and the suction and ejection mode driving control circuit 58 in that order according to an increase in the measured time by the cleaning lapse timer 53 at that time. Then, the cleaning mechanism 59 is allowed to perform the cleaning operation. In the cleaning main controller 52, a condition for selecting a control circuit that starts upon the cleaning operation is arbitrarily set. When the measured time by the cleaning lapse timer 53 is equal to or more than a predetermined time, the suction and ejection mode driving control circuit 58 starts, regardless of the presence/absence of printing, and the cleaning mechanism 59 is allowed to perform the cleaning operation including the suction and ejection operation. In this embodiment, the predetermined time is set to 360 hours.

When the printing operation is performed before the predetermined time, a slight cleaning operation by the trace amount flashing mode driving control circuit 57 or the normal flashing mode driving control circuit 56 is performed before printing according to the measured time by the cleaning lapse timer 53. A time required for the slight cleaning operation is much shorter than the cleaning operation including the suction and ejection operation. Accordingly, there is a clear distinction between the slight cleaning operation and the cleaning operation including the suction and ejection operation.

After printing by the printing head 21 ends and the automatic cutting operation is performed on the printed paper 11*a*, the cleaning main controller 52 judges whether or not the measured time by the cleaning lapse timer 53 is equal to or more than a judgment time set to be earlier than the predetermined time. Then, when it is judged that the measured time is equal to or more than the judgment time, the cleaning main controller 52 starts the suction and ejection mode driving control circuit 58. In this embodiment, the judgment time is set to 350 hours, which is earlier than the predetermined time by ten hours.

Next, a head maintenance method of this embodiment will be described with reference to the flowchart of FIG. 6.

After the printing operation by the printing head 21 completely ends, when a printed portion of the paper 11*a* is output from the paper issuing port 6, the paper 11*a* is cut at a predetermined length by the automatic cutting operation of the automatic cutter. With the automatic cutting operation (AC operation) as a trigger, a head maintenance operation sequence starts (Step S01). Then, first, the cleaning main controller 52 judges whether or not the measured time (CL elapsed time T1) by the cleaning lapse timer 53 is equal to or more than the judgment time (e.g., 350 hours) (Step S02).

At Step S02, when it is judged that the measured time by the cleaning lapse timer 53 is less than the judgment time, the sequence of the head maintenance operation including the suction and ejection operation of sucking the ink liquid from the ink nozzles and causing the ink liquid to be ejected from the ink nozzles ends (Step S03). At the same time, the printing head 21 returns to the standby state.

In this case, according to the increase in the measured time by the cleaning lapse timer 53 at that time, the trace amount flashing mode driving control circuit 57 or the normal flashing mode driving control circuit 56 starts, and trace amount flashing or normal flashing is performed before the next printing. The descriptions thereof will be omitted, and only the description of the cleaning operation including the suction and ejection operation will be given.

At Step S02, when it is judged that the measured time by the cleaning lapse timer 53 is equal to or more than the judgment time, the cleaning main controller 52 starts the suction and ejection mode driving control circuit 58 and allows the cleaning mechanism 59 to perform the cleaning operation including the suction and ejection operation (Step S04).

When the cleaning operation at Step S04 ends, the cleaning main controller 52 stores a cleaning end time in the memory 55, resets the measured time (CL elapsed time T1) of the cleaning lapse timer 53, and ends the sequence of the head maintenance operation (Step S05). At the same time, the printing head 21 returns to the standby state.

With the sequence of the head maintenance operation of this embodiment, after the printing operation by the printing head 21 ends, when the elapsed time from when the last cleaning operation including the suction and ejection operation ends is equal to or more than the judgment time, the cleaning operation including the suction and ejection operation is performed. For this reason, when the printing operation ends in a state where the judgment time from when the last cleaning operation ends lapses, the cleaning operation is directly performed without waiting for a timing at which next printing starts. Before a predetermined time from when the cleaning operation ends lapses, the cleaning operation is not performed when the next printing starts.

That is, when the standby state where the printing operation is not performed from when the last cleaning operation ends does not continue for a predetermined time or more, the cleaning operation immediately after printing is performed before the predetermined time from when the last cleaning operation ends. However, the cleaning operation when printing starts is not performed. Accordingly, it is possible to prevent a timing at which printing actually starts from being delayed due to the cleaning operation when printing starts, and to reduce a time waiting for printing to end, thereby improving throughput. Further, since the cleaning operation is performed whenever the judgment time substantially lapses, the ink nozzles can be kept in a well-maintained state.

In particular, when the printer 1 is used to print a discount coupon of a product at the checkout counter of the supermarket, during or after the settlement at the checkout counter, it is possible to print and issue the coupon without waiting for a long time due to the cleaning operation. Therefore, the customer is not kept waiting, and the time at the checkout counter can be reduced. As a result, work efficiency at the checkout counter can be improved.

In addition, as shown in FIG. 6, separately from a case where the automatic cutting operation is used as a trigger, when the measured time by the cleaning lapse timer 53 becomes the predetermined time (e.g., 360 hours) in a state where the printing operation is not performed and the cleaning operation including the suction and ejection operation on the printing head 21 is not performed (Step S06), the cleaning main controller 52 preferentially starts the suction and ejection mode driving control circuit 58 and allows the cleaning mechanism 59 to perform the cleaning operation including the suction and ejection operation with the above-described state as a trigger (Step S04).

As such, when the predetermined time lapses in a state where the printing operation is not performed from when the last cleaning operation including the suction and ejection operation ends, the cleaning operation including the suction and ejection operation is preferentially performed without waiting for the start of the next printing. Accordingly, a time at which the printing head 21 is not cleaned becomes at most equal to the predetermined time. Therefore, the ink nozzles can be constantly kept in a well-maintained state, and degradation in printing quality, such as missing dot, can be prevented.

Next, a second embodiment of the invention will be described.

Although the suction amount in the suction and ejection operation is fixed in the first embodiment of the invention, in the second embodiment, a suction and ejection operation is performed by a strong suction force for every predetermined number of suction and ejection operation times, and a normal suction and ejection operation is performed at appropriate strength. Ink consumption can thus be suppressed.

Hereinafter, the second embodiment will be described with reference to the drawings. In the drawings or the description, the same parts as those in the above-described embodiment are represented by the same reference numerals, and the descriptions thereof will be omitted.

In the first embodiment, the accumulative printing timer 54 that measures the accumulative printing time by the printing head 21 is provided. In the second embodiment, a cleaning accumulation counter 60 (indicated by a one-dot-chain line of FIG. 5) counts the number of accumulation times of the cleaning operation performed by operating the suction and ejection mode driving control circuit 58.

Next, the head maintenance device 51 including the cleaning mechanism 59 that cleans the printing head 21 and the cleaning controller 50 that controls the operation of the cleaning mechanism 59 will be described with reference to FIG. 5.

The cleaning accumulation counter 60 counts the number of accumulation times of the cleaning operation performed in the suction and ejection mode from when power is initially supplied to the printer 1. The number of accumulation times is referred to by the cleaning main controller 52 when a suction amount of the ink liquid in the suction and ejection operation, that is, a strength level of the suction and ejection operation, is determined. Further, the number of accumulation times counted by the cleaning accumulation counter 60 is sequentially stored in the memory 55.

Next, the head maintenance method of this embodiment will be described with reference to the flowchart of FIG. 8. In the first embodiment, with an instruction to allow the cleaning mechanism 59 to perform the cleaning operation including the suction and ejection operation (Step S04) as a trigger, the sequence of the head maintenance operation is started (Step S11).

The cleaning main controller 52 determines the strength level of the suction and ejection operation when the cleaning mechanism 59 is allowed to perform the cleaning operation including the suction and ejection operation (setting of CL parameter: Step S12). The strength level of the suction and ejection operation is set according to the number of accumulation times counted by the cleaning accumulation counter 60 and the ink residual quantity of the ink cartridge 17.

Next, the ink residual quantity of each color in the ink cartridge 17 is detected through an access to the IC chip of the ink cartridge 17, and a preliminary calculation is performed on whether or not an ink end occurs by ink consumption when the cleaning operation is performed at the strength level set at Step S12 (pre-CL judgment: Step S13). In the pre-CL judgment, a waste liquid amount in the ink cartridge 17 is detected, and a preliminary calculation is performed on whether or not a waste liquid amount stored in the ink cartridge 17 when the cleaning operation is performed is equal to or more than a tolerance (over-waste liquid).

After the pre-CL judgment of Step S13, it is judged whether or not error judgment is made with respect to at least one of the ink end and the over-waste liquid (Step S14). Then, when it is judged at Step S14 that the error judgment is made, the carriage 23 is disposed at the standby position, such that the ink nozzle of the printing head 21 is covered with the cap 27 (setting of CR lock: Step S17). At the same time, an error processing causing the display unit 112 (display lamps 41 to 44) to display the ink end or the over-waste liquid is performed (Step S18).

Meanwhile, when it is judged at Step S14 that the error judgment is not made, the cleaning main controller 52 starts the suction and ejection mode driving control circuit 58 using the parameters set at Step S12, and allows the cleaning mechanism 59 to perform the cleaning operation including the suction and ejection operation (Step S15).

After the cleaning operation of Step S15 ends, the cleaning main controller 52 stores a cleaning end time in the memory 55, resets the measured time (CL elapsed time T1) of the cleaning lapse timer 53, increments the count of the cleaning accumulation counter 60 by one, and ends the sequence of the head maintenance operation (Step S16). At the same time, the printing head 21 returns to the standby state.

Figure 9:
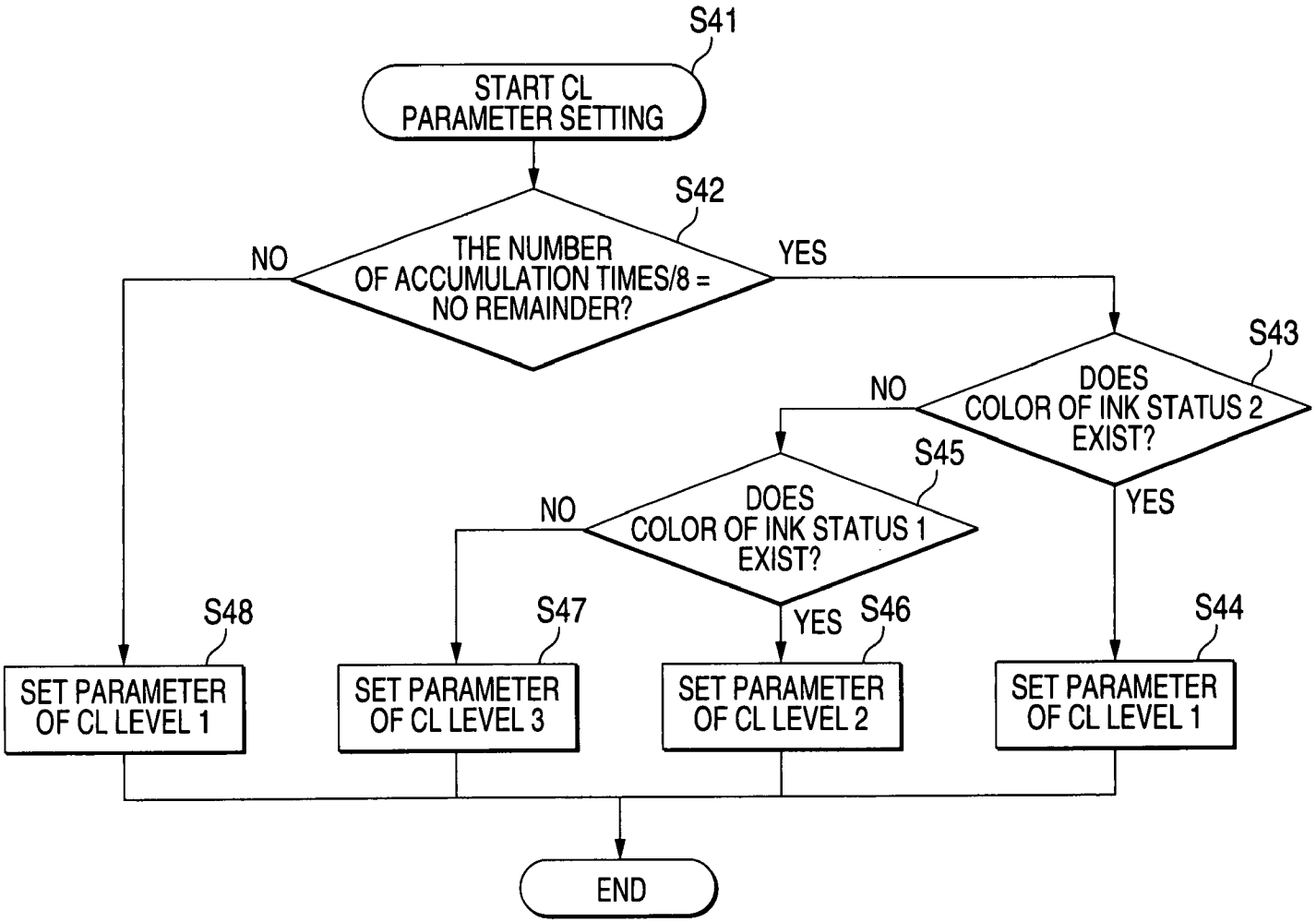
FIG. 9 is a flowchart showing the details of setting of cleaning parameters shown in FIG. 8.

The sequence of setting of the CL parameter at Step S12 will be described with reference to FIG. 9. Moreover, the CL parameter primarily sets the number of steps of a motor that drives the ink suction pump of the ink suction mechanism 29.

Setting of the CL parameter starts with Step S12 of FIG. 8 (Step S41). Then, first, the number of accumulation times of the cleaning operation counted by the cleaning accumulation counter 60 is referred to, and it is judged whether or not the number of accumulation times is a multiple of a predetermined number (in this embodiment, 8) (Step S42).

At Step S42, when it is judged that the number of accumulation times of the cleaning operation is not a multiple of 8 (Step S42: No), a parameter of a cleaning level 1 is set. The cleaning level is strength of the suction and ejection operation, and the suction and ejection amount (ink consumption) from the printing head 21 varies according to the level. The cleaning level 1 is a level of a normal suction and ejection operation. A slightly stronger suction and ejection operation than the normal suction and ejection operation is set to a cleaning level 2, and a suction and ejection operation that is performed at much stronger back pressure by closing a choke valve is set to a cleaning level 3.

At Step S42, when it is judged that the number of accumulation times of the cleaning operation is a multiple of 8 (Step S42: Yes), one of the cleaning levels 1 to 3 is set according to the ink residual quantity. Moreover, the ink residual quantity is judged according to five divided levels of ink statuses 0 to 4. An ink status 0 is a level indicating the most ink residual quantity, then subsequent levels are set in the order in which the ink residual quantity is decreasing, and an ink status 4 is a level indicating that the ink end is judged. First, it is judged whether or not ink corresponding to an ink status 2 of a comparatively small ink residual quantity exists for each color (Step S43). When the color of the ink status 2 exists, the parameter of cleaning level 1 is set (Step S44).

When it is judged at Step S43 that the color of the ink status 2 does not exist, it is judged whether or not ink corresponding to the ink status 1 (of more ink residual quantity than the ink status 2) exists for each color (Step S45). When the color of the ink status 1 exists, the parameter of the cleaning level 2 is set (Step S46).

When it is judged at Step S45 that the color of the ink status 1 does not exist, the parameter of cleaning level 3 is set (Step S47).

As such, when the number of accumulation times of the cleaning operation is a multiple of a predetermined number, that is, for every predetermined number of times, a stronger cleaning operation than other cases is performed according to the ink residual quantity. Accordingly, when the number of accumulation times is not a multiple of a predetermined number, a cleaning operation is performed with appropriate strength while ink consumption is suppressed, such that the states of the ink nozzles are maintained. Further, since a strong cleaning operation is performed for every predetermined number of times, the states of the ink nozzles are reset, and thus the ink nozzles are kept in a well-maintained state.

In addition, when the number of accumulation times becomes a multiple of a predetermined number, a cleaning operation of appropriate strength is selected according to the ink residual quantity. Accordingly, a cleaning operation of appropriate strength is performed such that the ink end is prevented, and ink supplied to the printing head 21 is not used up.

As described above, according to the head maintenance method, the head maintenance device 51, and the printer 1 of this embodiment, the cleaning operation including the suction and ejection operation is performed after printing ends before the predetermined time set for the cleaning operation. Accordingly, it is possible to prevent a timing at which printing actually starts from being delayed due to the cleaning operation when printing starts, and to reduce a time waiting for printing to end, thereby improving throughput.

The invention is not limited to the above-described embodiments, but various changes can be made. For example, although the ink jet printer is exemplified, the invention can be applied to an apparatus and a method of ejecting a liquid other than ink from a head.

Further, although an example where the cleaning lapse timer 53 measures the elapsed time from when the cleaning mechanism 59 ends the last cleaning operation, the cleaning lapse timer 53 may measure the elapsed time with a head cleaning instruction as a trigger. Here, the measurement of the elapsed time from when the cleaning operation ends is more desirable in that a desired cleaning operation can be reliably performed even though an error occurs during the cleaning operation.

In addition, although a case where the power supply of the printer is not cut off and the printer is constantly connected to the host computer has been described, in a state where the power supply of the printer is cut off and the printer is disconnected from the host computer, when power is applied to the printer and the elapsed time by the cleaning lapse timer 53 exceeds the predetermined time of 360 hours already, a cleaning operation including an ejection operation can be rapidly performed.

What is claimed is:

1. A head maintenance method for a printing head having ink nozzles capable of ejecting an ink liquid, the method comprising:

performing a cleaning operation by sucking the ink liquid from the ink nozzles;

measuring an elapsed time from when the last cleaning operation is performed; and if the elapsed time extends over a predetermined judgment time, performing the next cleaning operation in response to a cutting operation for automatically cutting a paper which is printed by the printing head during a printing operation.

2. The head maintenance method according to claim 1, wherein, when the elapsed time extends over a predetermined time longer than the judgment time, the next cleaning operation is performed before the printing operation starts without the cutting operation.

3. The head maintenance method according to claim 1, wherein, when a predetermined time longer than the judgment time lapses, the next cleaning operation is performed without the cutting operation.

4. The head maintenance method according to claim 1, wherein a judgment on whether or not the elapsed time extends over the judgment time is performed after the cutting operation ends.

5. The head maintenance method according to claim 1, wherein the elapsed time is measured from when the last cleaning operation ends.

6. A head maintenance device comprising:

a printing head that has ink nozzles capable of ejecting an ink liquid;

a cleaning mechanism that sucks the ink liquid and causes the ink liquid to be ejected from the nozzles of the printing head so as to clean the printing head;

a cleaning driving control circuit that operates the cleaning mechanism to perform a cleaning operation;

a cleaning lapse timer that measures an elapsed time from the last cleaning operation;

a cutting mechanism that cuts a paper automatically after a printing operation by the printing head ends; and a controller that starts the cleaning driving control circuit for the next cleaning operation in response to the cutting operation by the cutting mechanism, if the elapsed time extends over a predetermined judgment time.

7. The head maintenance device according to claim 6, wherein, when the elapsed time extends over a predetermined time longer than the judgment time, the controller causes the next cleaning operation to be performed before the printing operation starts without the cutting operation.

8. The head maintenance device according to claim 6, wherein, when the elapsed time from the last cleaning operation extends over a predetermined time longer than the judgment time, the controller starts the cleaning driving control circuit without the cutting operation.

9. The head maintenance device according to claim 6, wherein, after the cutting operation ends, the controller performs a judgment on whether or not the elapsed time extends over the judgment time.

10. The head maintenance device according to claim 6, wherein the cleaning lapse timer measures the elapsed time from when the last cleaning operation ends.

11. The head maintenance device according to claim 6, further comprising:

a cleaning accumulation counter that counts a number of accumulation times of the start of the cleaning driving control circuit, wherein, when it is judged whether or not the measured time is equal to or more than the judgment time and the number of accumulation times counted by the cleaning accumulation counter is a multiple of a predetermined number, the controller applies a setting to the cleaning driving control circuit for a stronger cleaning operation compared with a case where the number of accumulation times is not the multiple of the predetermined number.

12. The head maintenance device according to claim 11, wherein the setting for the stronger cleaning operation to be applied to the cleaning driving control circuit is determined according to a residual quantity of ink to be supplied to the printing head.

13. A printer comprising the head maintenance device according to claim 6.

14. The head maintenance method according to claim 1, wherein, when it is judged that the elapsed time extends over the judgment time and the number of accumulation times of the cleaning operation is a multiple of a predetermined number, a stronger cleaning operation is performed compared with a case where the number of accumulation times is not the multiple of the predetermined number.

15. The head maintenance method according to claim 14, wherein the strength of the cleaning operation is determined according to a residual quantity of ink to be supplied to the printing head.

* * * * *